US010588480B2

(12) United States Patent
Lee et al.

(10) Patent No.: US 10,588,480 B2
(45) Date of Patent: Mar. 17, 2020

(54) DISHWASHER AND CONTROL METHOD THEREFOR

(71) Applicant: LG ELECTRONICS INC., Seoul (KR)

(72) Inventors: Sangsoo Lee, Seoul (KR); Kyuhyung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 52 days.

(21) Appl. No.: 15/738,100

(22) PCT Filed: Jun. 10, 2016

(86) PCT No.: PCT/KR2016/006169
§ 371 (c)(1),
(2) Date: Dec. 19, 2017

(87) PCT Pub. No.: WO2016/204454
PCT Pub. Date: Dec. 22, 2016

(65) Prior Publication Data

US 2018/0184880 A1 Jul. 5, 2018

(30) Foreign Application Priority Data

Jun. 19, 2015 (KR) ..... 10-2015-0087161

(51) Int. Cl.
*A47L 15/42* (2006.01)
*A47L 15/23* (2006.01)
*A47L 15/00* (2006.01)

(52) U.S. Cl.
CPC ..... *A47L 15/4282* (2013.01); *A47L 15/0018* (2013.01); *A47L 15/23* (2013.01);
(Continued)

(58) Field of Classification Search
CPC combination set(s) only.
See application file for complete search history.

(56) References Cited

U.S. PATENT DOCUMENTS

2010/0139719 A1* 6/2010 Gnadinger ..... A47L 15/4282 134/56 D
2014/0332041 A1 11/2014 Feddema

FOREIGN PATENT DOCUMENTS

DE 8802328 U 8/1988
EP 0795292 9/1997
(Continued)

OTHER PUBLICATIONS

Machine translation of JP2010162262—corresponds to JP5146331.*
(Continued)

*Primary Examiner* — Erin F Bergner
(74) *Attorney, Agent, or Firm* — Fish & Richardson P.C.

(57) ABSTRACT

A dishwasher includes: a tub; a sump configured to collect wash water sprayed into the tub; a spraying arm including: first and second channels configured to independently guide the wash water; and a plurality of spraying holes configured to spray the wash water supplied to each of the channels in preset directions; a supply pump configured to supply the wash water collected in the sump to the spraying arm, the supply pump including: an impeller; and a motor configured to drive the impeller; a flow path conversion unit configured to selectively supply the wash water to the first channel or the second channel; and a controller configured to cause the flow path conversion unit to selectively supply the wash water to the first channel or the second channel by controlling the operation of the motor based on a value of an electrical current flowing through the motor.

7 Claims, 10 Drawing Sheets

(a)

(b)

(52) U.S. Cl.
CPC ..... *A47L 15/4208* (2013.01); *A47L 2401/08* (2013.01); *A47L 2501/20* (2013.01); *A47L 2501/26* (2013.01)

(56) References Cited

FOREIGN PATENT DOCUMENTS

| | | | |
|---|---|---|---|
| EP | 2522268 | | 11/2012 |
| EP | 2954829 | | 12/2015 |
| GB | 2204482 | | 11/1988 |
| JP | 2008289681 | | 12/2008 |
| JP | 2010162262 | * | 7/2010 |
| JP | 5146331 | | 2/2013 |
| KR | 100267937 | | 7/2007 |
| KR | 10-2012-0126598 | | 11/2012 |
| KR | 101259114 | | 4/2013 |
| WO | WO2001019229 | | 3/2001 |
| WO | WO2008125482 | | 10/2008 |
| WO | 2011/132356 | | 10/2011 |

OTHER PUBLICATIONS

International Search Report in International Application No. PCT/KR2016/006169, dated Sep. 13, 2016, 30 pages (with English translation).
Office Action in Australian Patent Application No. 2016278522, dated Aug. 8, 2018, 6 pages.
European Search Report in European Appln. No. 16811867.7, dated Jan. 2, 2019, 10 pages.

* cited by examiner (a)

(b)

(a)

(b)

DISHWASHER AND CONTROL METHOD THEREFOR

CROSS-REFERENCE TO RELATED APPLICATIONS

This application is a National Phase application of PCT International Application no. PCT/KR2016/006169, filed on Jun. 10, 2016, which claims priority under 35 U.S.C. 119(a) to Patent Application no. 10-2015-0087161, filed in the Republic of Korea on Jun. 19, 2015, which is hereby incorporated by reference herein in their entirety.

TECHNICAL FIELD

Embodiments of the present disclosure relate to a dishwasher and a control method therefor, more particularly, a dishwasher which is capable of determining a plurality of channels provided in an spraying arm based on a current value in a motor mounted in a supply pump and selectively using each of spraying nozzles based on the result of determination, and a control method of the dishwasher.

BACKGROUND ART

Generally, a dishwasher is the electric appliance configured to remove food scraps or foreign substances from one or more dishwashing objects (e.g., dishes or cooking tools) held therein by spraying dishwasher detergents and wash water to the dishes.

Such a conventional dishwasher includes a tub providing a washing space for dishes; a dispenser for accommodating dishwasher detergents; one or more dish racks provided in the tub and holding washing objects therein; an spraying arm for spraying wash water to the dish racks; a sump storing wash water; and a water supply path for supplying the wash water stored in the sump to the spraying arm.

In this instance, a plurality of water supply channels provided in the spraying arm. The plurality of the wash water supply channels may be formed to communicate with a plurality of corresponding spraying holes.

Meanwhile, one of the wash water supply channels may be formed to communicate with one or more spraying holes for spraying wash water toward the dispenser or filter.

In the conventional dishwasher, it is impossible to know to which one of the wash water supply channels the wash water is supplied.

To solve the disadvantage, the wash water has to be alternatively supplied to the plurality of the wash water supply channels so as to spray the wash water toward the dispenser or filter.

However, the wash water needs to be sprayed toward the dispenser accommodating the dishwasher detergents in an initial stage of a wash cycle for a preset time period intensively so as to enhance washing efficiency.

More specifically, it is impossible in the conventional dishwasher to intensively spray the wash water toward the dispenser or the filter as long as needed at a required time point.

Also, the spraying arm may be provided to rotate in a clockwise or counter-clockwise direction. For example, the plurality of the wash water supply channels may be formed in communication with the plurality of the corresponding spraying holes, respectively.

The plurality of the spraying holes formed in the spraying arm may be directional at a preset angle with respect to an upper or lower surface of the spraying arm. Accordingly, the spraying arm is rotatable by the reaction of the force for spraying the wash water via the spraying holes.

At this time, the rotational directions of the spraying may be determined based on which one of the wash water supply channels the wash water is supplied to.

Such the rotational directions of the spraying arm needs to be controlled differently based on the types or arrangement of the washing objects so as to enhance the washing efficiency.

It is impossible in the conventional dishwasher to know which one of the wash water supply channels the wash water is supplied. Accordingly, the rotational directions of the spraying arms have to be periodically changed in the conventional dishwasher and the rotational directions of the spraying arm cannot be determined and controlled actively.

DISCLOSURE

Technical Problem

To overcome the disadvantages, an object of the present disclosure is to provide a dishwasher which is capable of determining or recognizing which one of the channels provided in an spraying arm wash water is supplied to, and a control method thereof.

Another object of the present disclosure is to provide a dishwasher which is capable of intensively spraying wash water toward a dispenser inn an initial stage of a wash cycle based on the result of the determination about the channel through which the wash water is supplied, and a control method thereof.

A further object of the present disclosure is to provide a dishwasher which is capable of actively controlling rotational directions of the spraying arm by determination of the channel through which wash water is supplied, and a control method thereof.

Technical Solution

To achieve these objects and other advantages and in accordance with the purpose of the embodiments, as embodied and broadly described herein, a dishwasher comprises a tub which defines a dishwashing space; a sump in which the wash water sprayed into the tub is collected; an spraying arm comprising first and second channels configured to circulate wash water distinguishably and a plurality of spraying holes configured to spray the wash water supplied to each of the channels in a preset direction; a supply pump comprising an impeller and a motor configured to drive the impeller and configured to supply the wash water collected in the sump to the spraying arm; a flow path conversion unit configured to selectively supply wash water to the first channel or the second channel according to the drive of the supply pump; and a controller implemented to control the drive of the motor, wherein the controller controls the drive of the motor to selectively supply the wash water to the first channel or the second channel based on a current value flowing to the motor.

The first channel and the second channel may be formed to communicate with the plurality of the corresponding spraying holes, respectively, and the entire cross section area of the spraying holes corresponding to the first channel may be different from the entire cross section area of the spraying holes corresponding to the second channel.

When wash water is alternatively supplied to the first and second channels by the operation of the flow path conversion unit, the controller may distinguish a first state in which the wash water is supplied to the first channel and a second state in which the wash water is supplied to the second channel from each other, based on the current values flowing to the motor.

The sum of the cross section areas of the spraying holes corresponding to the first channel may be larger than the sum of the cross section areas of the spraying holes corresponding to the second channel, and a first current value flowing to the motor in the first state may be smaller than a second current value flowing to the motor in the second state.

The number of the spraying holes corresponding to the first channel may be larger than the number of the spraying holes corresponding to the second channel.

The number of the spraying holes corresponding to the first channel may be equal to the number of the spraying holes corresponding to the second channel, and a diameter of each spraying hole corresponding to the first channel may be larger than a diameter of each spraying hole corresponding to the second channel.

The direction in which the spraying holes corresponding to the first channel are formed may be different from the direction in which the spraying holes corresponding to the second channel are formed, and when wash water is supplied to the first channel, the spraying arm may be rotated in a clockwise direction, and when wash water is supplied to the second channel, the spraying arm may be rotated in a counter-clockwise direction.

The spraying holes corresponding to the first channel may be configured to spray wash water toward the dishwashing objects held in the tub, and the spraying holes corresponding to the second channel may comprise a first spraying hole configured to spray wash water toward a dispenser configured to accommodate dishwasher detergents; and a second spraying hole configured to spray wash water toward a filter provided in an upper surface of the sump.

When the dishwasher is driven according to a preset dishwashing course, the controller may control the supply pump to supply wash water via the second channel for a preset time period after determining the current value flowing to the motor when wash water is supplied to the first channel and the current value flowing to the motor when wash water is supplied to the second channel.

The preset dishwashing course may comprise a channel determining cycle for implementing the controller to determine the current value flowing to the motor when wash water is supplied to the first channel and the current value flowing to the motor when wash water is supplied to the second channel; and a washing cycle for spraying wash water toward the dishwashing objects held in the tub, and the channel determining cycle and the washing cycle may be performed in order, and the controller may control the supply pump to supply wash water to the second channel in an initial stage of the washing cycle for the preset time period.

The dishwasher may further comprise a current sensor configured to measure the current values flowing to the motor, wherein the current sensor is electrically connected with the controller.

In another aspect of the present disclosure, a control method of a dishwasher comprising a tub, spraying arm, a supply pump configured to supply wash water to the spraying arm and a controller implemented to control the drive of the supply pump, wherein the spraying arm comprises first and second channels configured to circulate wash water distinguishably and a plurality of spraying holes configured to spray the wash water supplied to each of the channels in a preset direction, and the entire cross section area of the spraying holes corresponding to the first channel is different from the entire cross section area of the spraying holes corresponding to the second channel, the control method comprises a channel determining step for implementing the controller to determine a first state in which wash water is supplied to the first channel and a second state in which wash water is supplied to the second channel; and a washing step for spraying wash water toward the dishwashing objects held in the tub.

The channel determining step may comprise a first wash water supplying step for supplying wash water to one of the first and second channels by the drive of the supply pump; a first current measuring step for measuring the current value flowing to a motor provided in the supply pump in the first wash water supplying step; a second wash water supplying step for supplying wash water to the other one of the first and second channels by the drive of the supply pump; a second current measuring step for measuring the current value flowing to the motor provided in the supply pump in the second wash water supplying step; and a current value comparing step for comparing the current value measured in the first current measuring step with the current value measured in the second current measuring step by implementing the controller.

In the current value comparing step, the controller may determine a first state in which wash water is supplied to the first channel and a second state in which wash water is supplied to the second channel based on the result of the current value comparison.

The sum of the cross section areas of the spraying holes corresponding to the first channel may be larger than the sum of the cross section areas of the spraying holes corresponding to the second channel, and a first current value flowing to the motor in the first state may be smaller than a second current value flowing to the motor in the second state.

The control method of the dishwasher may further comprise a step for stopping the drive of the supply pump between the first current measuring step and the second wash water supplying step.

The spraying holes corresponding to the second channel may comprise at least one spraying hole configured to spray wash water toward a dispenser configured to accommodate dishwasher detergents, and the washing step may comprise a dispenser washing step for supplying wash water to the second channel; and a dishwashing step for supplying wash water to the first channel.

The dispenser washing step may be performed in an initial stage of the washing step for a preset time period.

Advantageous Effects

Accordingly, the embodiments have following advantageous effects. The dishwasher is capable of supplying steam even to washing objects placed in front or rear portions of a rack.

Furthermore, the dishwasher needs not use much water in drying washing objects.

Still further, the dishwasher is capable of supplying steam to dry washing objects.

BEST MODE

Referring to the accompanying drawings, exemplary embodiments of the present disclosure according to one embodiment of the present disclosure will be described in detail. Use of such terminology for structures and control methods herein is merely intended to facilitate description of the specification, and the terminology itself is not intended to give any special meaning or function. In the present disclosure, that which is well-known to one of ordinary skill in the relevant art has generally been omitted for the sake of brevity.

Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that embodiments of a device or a controlling method presented herein are not limited by the accompanying drawings.

Figure 1:
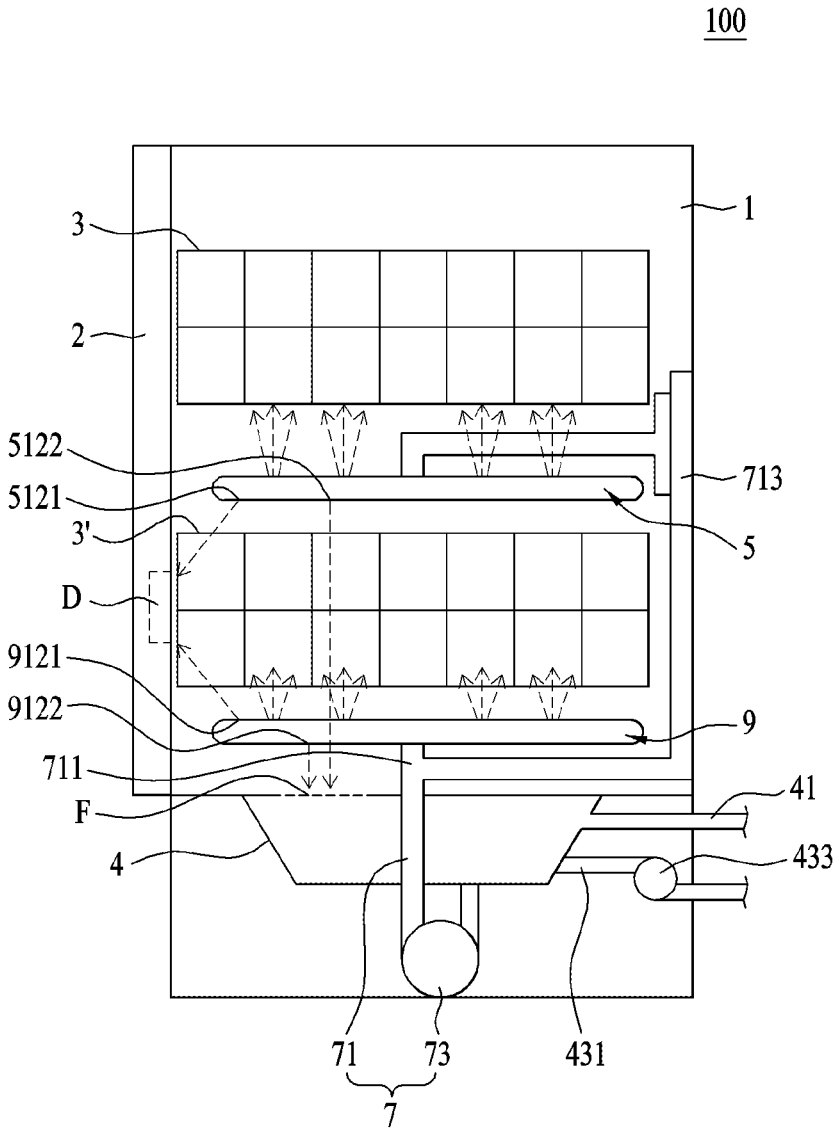
FIG. 1 is a diagram illustrating a basic structure of a dishwasher in accordance with one embodiment of the present disclosure.

Referring to FIG. 1, a dishwasher 100 in accordance with one embodiment may include a tub 1 defining a washing space; a door 2 provided to selectively open and close the washing space; and one or more dish racks 3 and 3' provided in the tub and configured to holding one or more washing objects thereon.

The racks 3 and 3' may be movable forwards from the dishwasher 100 when the door 2 is open.

A sump 4 may be further provided in a lower portion of the tub 1 and the wash water needed to wash the washing objects is stored in the sump 4. The sump 4 may be configured to collect the wash water sprayed into the tub 1.

The sump 4 is supplied the wash water via a sump water supply unit 41. The sump water supply unit 41 may include a water supply source (not shown) provided outside the dishwasher 100; and a water supply hose for allowing the water supply source to communicate with the sump 4.

The sump 4 may further include a sump water drainage unit 43 for draining the stored wash water outside the sump. The sump drainage 32 may include a water drainage hose 431 for allowing the sump to communicate with the outside of the dishwasher; and a water drainage pump 433.

Meanwhile, the dishwasher may include one or more spraying arms 5 and 9 provided in the tub 1 and configured to spray wash water toward the washing objects held on the dish racks 3 and 3'.

In this instance, the dish racks 3 and 3' may include an upper dish rack 3 located in a relatively upper portion; and a lower dish rack 3' located in a relatively lower portion. the one or more spraying arms 5 and 9 may include an upper spraying arm 5 for spraying wash water toward the upper dish rack 3; and a lower spraying arm 9 for spraying wash water toward the lower rack 3'.

For example, the upper dish rack 5 may be arranged under the upper dish rack 3 and configured to spray the wash water stored in the sump 4 toward the dishwashing objects held in the upper dish rack 3.

The upper spraying arm 5 may be formed to communicate with the sump 4 via a wash water supply unit 7.

In this instance, the wash water supply unit 7 may include a supply path 71; and a supply pump 73 for supplying the wash water stored in the sump 4 to the supply path 71.

The supply pump 73 may include an impeller (not shown); and a motor (see FIG. 2) provided to rotatably drive the impeller and configured to supply the wash water stored in the sump 4 toward the one or more spraying arms 5 and 9.

The upper spraying arm 9 may be arranged under the lower dish rack 3' and configured to spray the wash water stored in the sump 4 toward the dishwashing objects held on the lower dish rack 3'.

In this instance, the wash water supply unit 7 may include a first flow path 711 and a second flow path 713 which are branched from the supply path 71. The first flow path 711 may be connected with the lower spraying arm 9 and the second flow path 713 may be connected with the upper spraying arm 5.

Hereinafter, the structure of the upper spraying arm 5 will be described, referring to other drawings.

Figure 2:
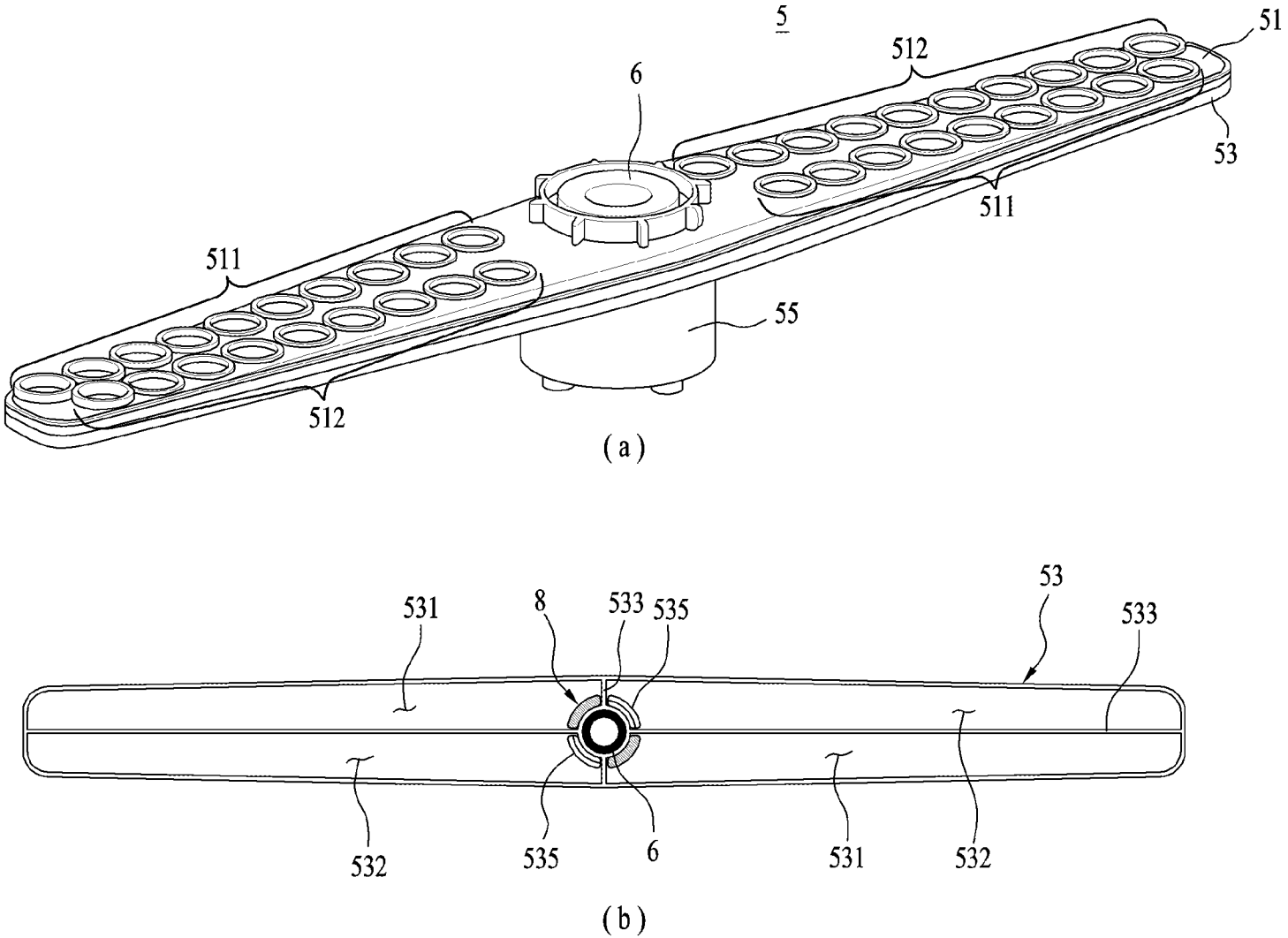
FIGS. 2 (*a*) and (*b*) are perspective diagrams of an upper spraying arm.

FIG. 2 is a perspective diagram of the upper spraying arm 5.

Referring to FIG. 2, the upper spraying arm 5 may include a first channel 531 and a second channel 532 for circulating the wash water distinguishably; and a plurality of spraying holes 511 and 512 for spraying the wash water drawn into the channels in preset directions, respectively.

At this time, the first channel 531 and the second channel 532 may be formed to communicate with the corresponding spraying holes 511 and 512, respectively.

Figure 3:
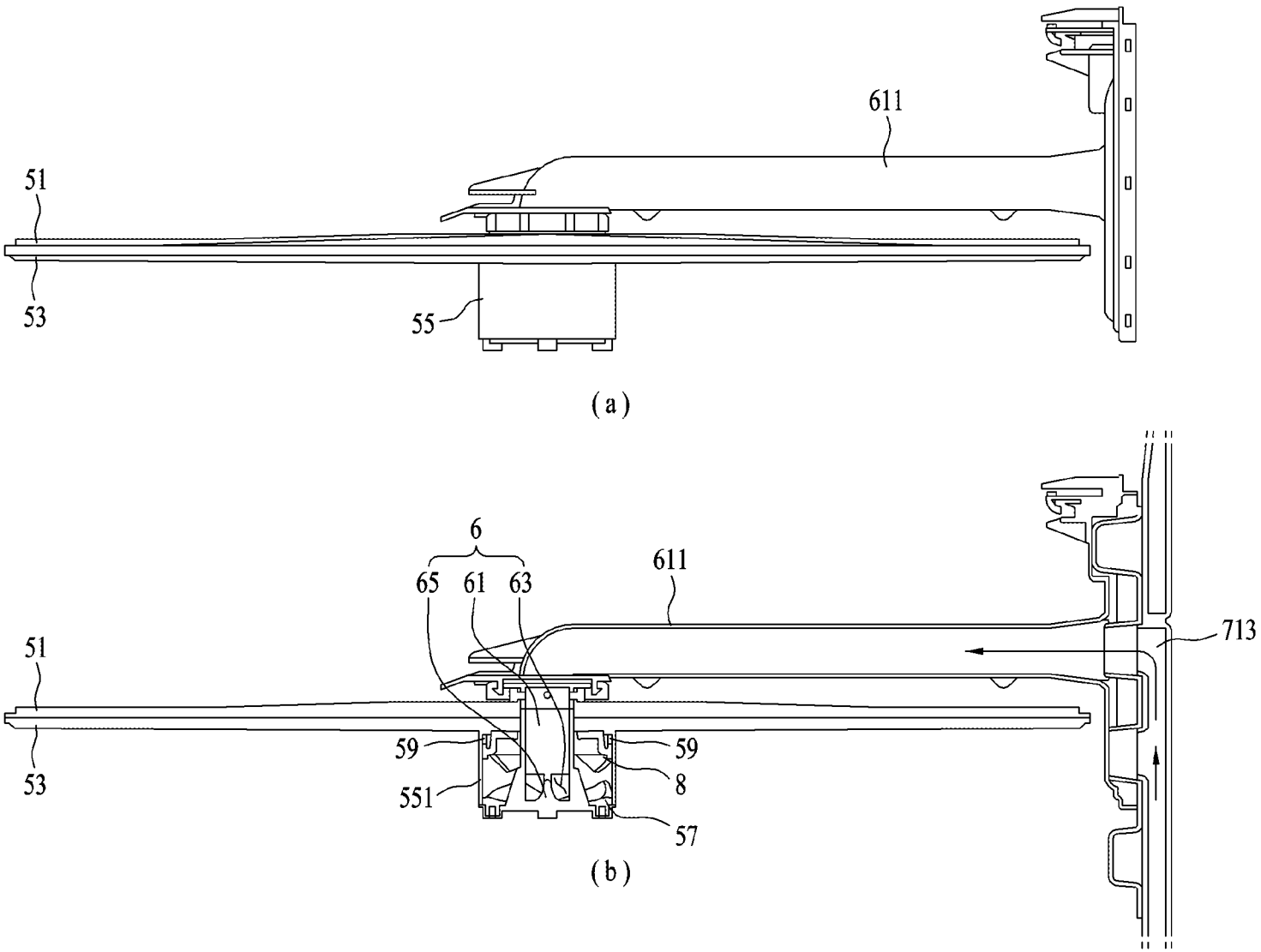
FIGS. 3 (*a*) and (*b*) are diagrams illustrating a coupling structure among a supply path, an spraying arm, a flow path guider and a flow path conversion unit.

As one example, the first channel 531 may be in communication with the plurality of the spraying holes with the numeral references '511' shown in FIG. 3. The second channel 532 may be in communication with the plurality of the spraying holes with the numeral references '512' shown in FIG. 3.

The entire cross sectional area of the spraying holes 511 corresponding to the first channel 531 may be different from that of the spraying holes 512 corresponding to the second channel 532.

Accordingly, the load or torque applied to the motor 731 of the supply pump 73 when wash water is supplied to the first channel 531 may be different from the load or torque applied to the motor (731, see FIG. 9) of the supply pump 73 when wash water is supplied to the second channel 531.

The bigger is the load or torque applied to the motor 731, the higher are the values of the currents flowing to the motor 731.

The controller (C) may be implemented to compare the values of the currents flowing to the motor 731 to the first channel 531 and the second channel 532 with each other and determine whether the wash water is supplied to the first channel 531 or the second channel 532 based on the result of the comparison.

Such the characteristics of the controller (C) will be described in detail later, referring to other drawings.

Meanwhile, the upper spraying arm 5 may include an upper body 51 having the spraying hole 511; a lower body 53 including a plurality of channels 531 and 532 provided under the upper body 51 and configured to distinguishably circulating the wash water; and a chamber 55 provided under the lower body 53 and configured to communicate with the first channel 531 and the second channel 532.

A partition wall 533 may be provided in the lower body 53 to partition off the internal space of the lower body into the first channel 531 and the second channel 532. A chamber communication hole 535 may be provided in the lower body 53 to facilitate the communication between the each of channels and the chamber.

Meanwhile, the dishwasher may further include a flow guider 6 in communication with the chamber 55, penetrating the upper body 51 and the lower body 53. The flow guider 6 may be connected with the second flow path 713 of the wash water supply unit 7 via a detachable pipe (611, see FIG. 3) and configured to supply wash water to the chamber 55.

In this instance, the upper body 51 and the lower body 53 may further include a flow guider through hole for allowing the flow guider 6 to pass through. It is preferred that the chamber communication hole 535 is provided along an outer circumferential surface of the flow guider through hole.

Wash water may be exhausted in a vertical direction with respect to a top surface of the upper body 51. Alternatively, the spraying holes 511 and 512 may be provided to allow the exhaustion angle of the wash water exhausted via the spraying holes 511 and 512 to form an acute angle with respect to a top surface of the upper body 51.

When the spraying holes 511 and 512 are provided to allow the exhaustion angle of the wash water to form the acute angle with respect to the top surface of the upper body 51, a repulsive force is generated in spraying the wash water via the spraying holes 511 and 512. Accordingly, when the upper spraying arm 5 is rotatable with respect to the detachable pipe 611, the spraying arm 5 is rotatable even without auxiliary drive devices and dishwashing efficiency may be enhanced.

In one embodiment, the direction in which the plurality of the spraying holes 511 corresponding to the first channel 531 are formed may be different from the direction in which the plurality of the spraying holes 512 corresponding to the second channel 532 are formed. At this time, the direction of the spraying holes 511 corresponding to the first channel 531 may be defined as 'the first formation direction' and the direction of the spraying holes 512 corresponding to the second channel 532 may be defined as 'the second formation direction'.

For example, the first formation direction and the second formation may be determined so as to rotate the upper spraying arm 5 in a clockwise direction when wash water is supplied to the first channel 531 and rotate the upper spraying arm 5 in a counter-clockwise direction when the wash water is supplied to the second channel 532.

Moreover, a flow conversion unit 8 may be further provided in the chamber 55 and configured to perform linearly reciprocating motion and rotational motion so as to selectively open some of the chamber communication holes 535.

The flow conversion unit 8 may be configured to selectively open the first channel 531 and the second channel 532 according to the drive of the supply pump 73. In other words, the flow conversion unit 8 may be provided to selectively supply the wash water to the first channel 531 or the second channel 532 according to the drive of the supply pump 73.

Hereinafter, the coupling structure among the flow guider 6, the chamber 55, the second flow path 713 and the flow path conversion unit 8 will be described referring to other drawings.

Figure 4:
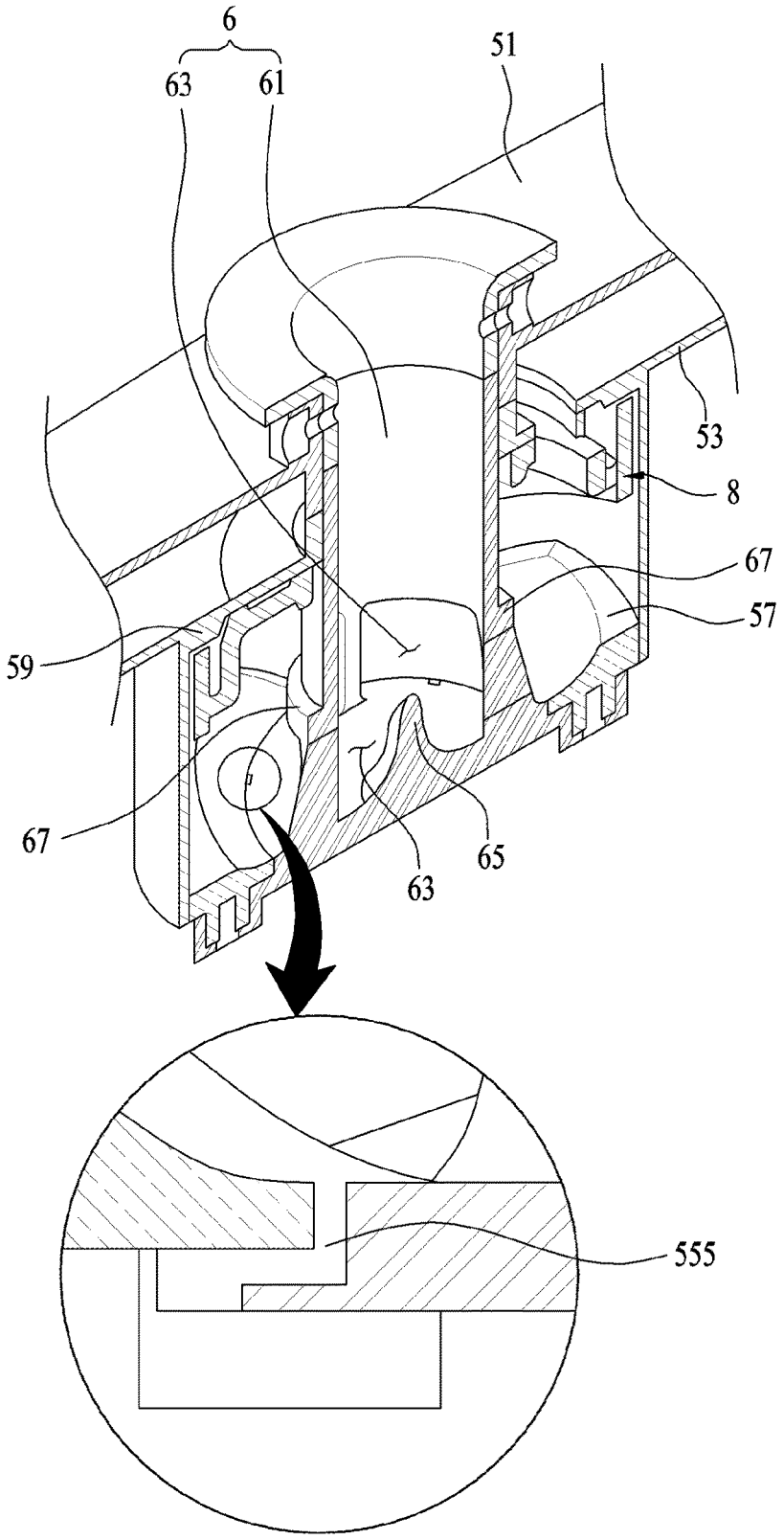
FIG. 4 is a sectional diagram illustrating the coupling among the spraying arm, the flow path guider and the flow path conversion unit.
Figure 5:
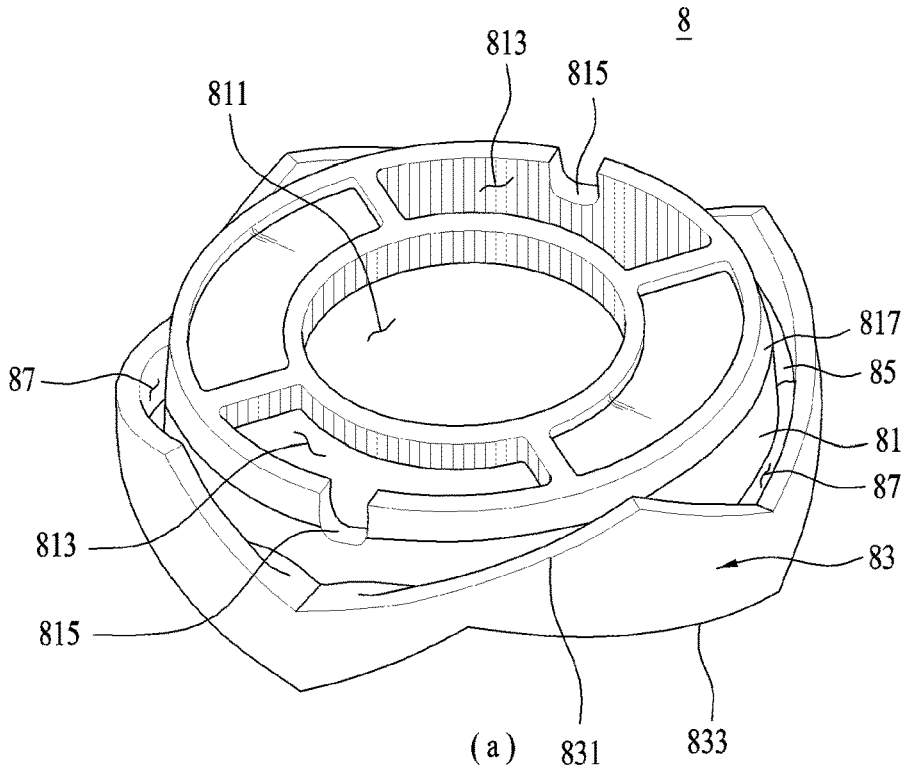
FIGS. 5 (*a*) and (*b*) include a perspective diagram and a plane view of the flow path converting unit.
Figure 5:
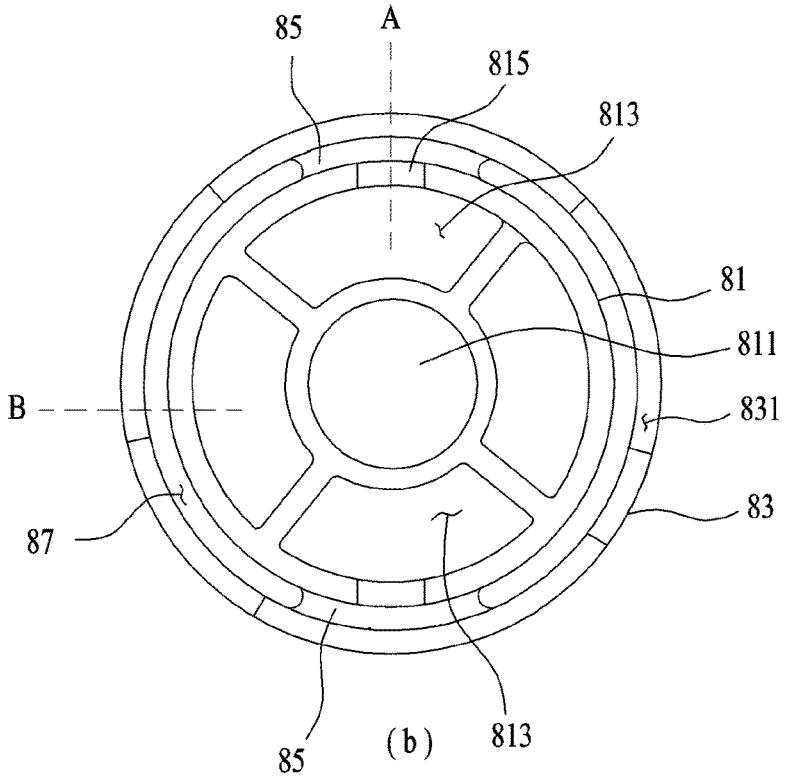

FIG. 3 is a diagram illustrating the coupling structure among the supply path, the spraying arm, the flow path guider and the flow path conversion unit. FIG. 4 is a sectional diagram illustrating the coupling among the spraying arm, the flow path guider and the flow path conversion unit. FIG. 5 includes a perspective diagram and a plane view of the flow path conversion unit.

Referring to FIGS. 3 through 5, the chamber 55 is the wash water circulating space provided underneath the lower body 53. The chamber 55 includes a body 551 extended along a downward direction of the lower body 53 to locate the chamber communication hole 535 therein.

The flow path guider 6 may include a detachable pipe 611 detachably provided in the second flow path 713; a hollow pipe 61 having one end connected with the detachable pipe 611 and the other end located in the chamber 55, penetrating the upper body 51 and the lower body 53; and an outlet hole 63 for exhausting the wash water supplied to the hollow pipe 61 into the chamber 55.

Referring to FIG. 4, the structure of the flow path guider 6 will be described in detail. The outlet hole 63 may be provided via an outer circumferential surface of the hollow pipe 61. Also, it is preferred that the outlet hole 63 is provided in the connection area between the hollow pipe 61 and a bottom of the chamber 5 to fill the wash water supplied via the hollow pipe 61 in the chamber 55 from the bottom.

Moreover, the flow path guider 6 may further include an outlet guider 65 for facilitating the circulation of the wash water toward the outlet hole 63. In this instance, the outlet guider 65 may be provided in a cone shape projected from the bottom of the chamber 55 and located in a center of the hollow pipe 61.

In case the outlet guider 65 is formed in the cone shape, a hypotenuse of the outlet guider may have a preset radius of curvature.

Accordingly, the wash water stored in the sump may be supplied to the chamber 55 by the supply pump 73, passing through the supply path 55, the second flow path 713, the detachable pipe 611, the hollow pipe 61 and the outlet hole 63. The wash water exhausted from the outlet hole 63 is guided toward the outlet hole 63 along the guide of the outlet guider 65 so as to minimize the shock applied to the chamber 55 by the wash water exhausted from the hollow pipe 61.

A remnant outlet pipe 555 for removing the remnant of the chamber 55 may be further provided in the bottom of the chamber 55.

The remnant outlet pipe 555 is configured to prevent the wash water from remaining in the chamber when the operation of the dishwasher is stopped. It is preferred that the remnant outlet pipe 555 has a bent profile to minimize the pressure decrease inside the chamber when wash water is supplied to the chamber 55.

When wash water is supplied to the chamber 55 via the hollow pipe 61, the flow path conversion unit 8 may move to a top of the chamber 55. When no wash water is supplied, the hollow pipe 61 may move toward the bottom of the chamber 55.

In case of moving toward the top of the chamber 55, the flow path conversion unit 8 may be rotated a preset angle to partially open the chamber communication holes 535.

Referring to FIG. 5, the structure of the flow path conversion unit 8 will be described in detail. The flow path conversion unit 8 may include a conversion unit body 81 formed in a hollow shape with an open bottom; a hollow pipe insertion hole 811 provided in an upper surface of the conversion unit body 81 and having the hollow pipe 61 therein; and a channel opening hole 813 provided in the upper surface of the conversion unit body 81.

In this instance, the outlet hole 63 of the flow path guider 6 may be located in the conversion unit body 81 (specifically, between the upper surface of the conversion unit body and the bottom of the chamber).

Moreover, the flow path guider 6 may further include a supporting portion (67, see FIG. 4) provided in an outer circumferential surface of the hollow pipe 61, while located over the outlet hole 63, and configured to support the upper surface of the conversion unit body 81.

It is preferred that the channel opening hole 813 is configured to open a predetermined number of the chamber communication holes 535 provided in the lower body 53.

More specifically, the number of the channel opening holes 813 may be different from that of the chamber communication holes 535. FIG. 2 (*b*) shows that the four chamber communication holes 535 spaced 90 degrees apart from each other are provided in the lower body 53 and that two channel opening holes 813 are provided in the conversion unit body 81.

Meanwhile, the two channel opening holes 813 are arranged adjacent to each other or spaced 180 degrees apart from each other (hereinafter, description will be made on the basis of the latter example).

Accordingly, whenever the conversion unit body 81 is rotated a preset angle by an engaging projection 83, an upper engaging portion 59 and a lower engaging portion 57, wash water may be supplied to the first channel 531 or the second channel 532.

When there is no wash water in the chamber 55, the conversion body unit 81 is configured to engage with the lower engaging portion 57 or keep the state of being supported by the supporting portion 67. Once wash water is supplied to the chamber 55, the conversion unit body 81 is configured to move toward the top of the chamber 55 along the guide of the hollow pipe 61.

Meanwhile, while the conversion unit 81 is rotated a preset angle toward the top of the chamber 55, the channel opening hole 813 is configured to open some of the chamber communication holes 535. Accordingly, the wash water supplied via the supply pump 73, the supply path 71 and the second flow path 713 may be supplied only to the first channel 531 or the second channel 532 provided in the spraying arm 5.

When the wash water supply to the chamber 55 is stopped, the conversion unit body 81 is rotated and moved toward the bottom of the chamber 55. After that, the wash water supply to the chamber 55 re-starts and the conversion unit body 81 is rotated to open the other chamber communication holes not open before, while being moved toward the top of the chamber 55 at the same time.

Accordingly, when the drive and stop of the supply pump 73 is repeated once the wash water is supplied toward the upper spraying arm 5 by the drive of the supply pump 73, the wash water may be alternatively supplied to the first channel 531 and the second channel 532 by the operation of the flow path conversion unit 8.

In the dishwasher in accordance with the embodiments of the present disclosure, wash water may be alternatively supplied to the plurality of the channels provided in one upper spraying arm 5 so as to diversify the spraying angles of the wash water sprayed toward the dishwashing objects and enhance the dishwashing performance of the dishwasher accordingly.

Figure 6:
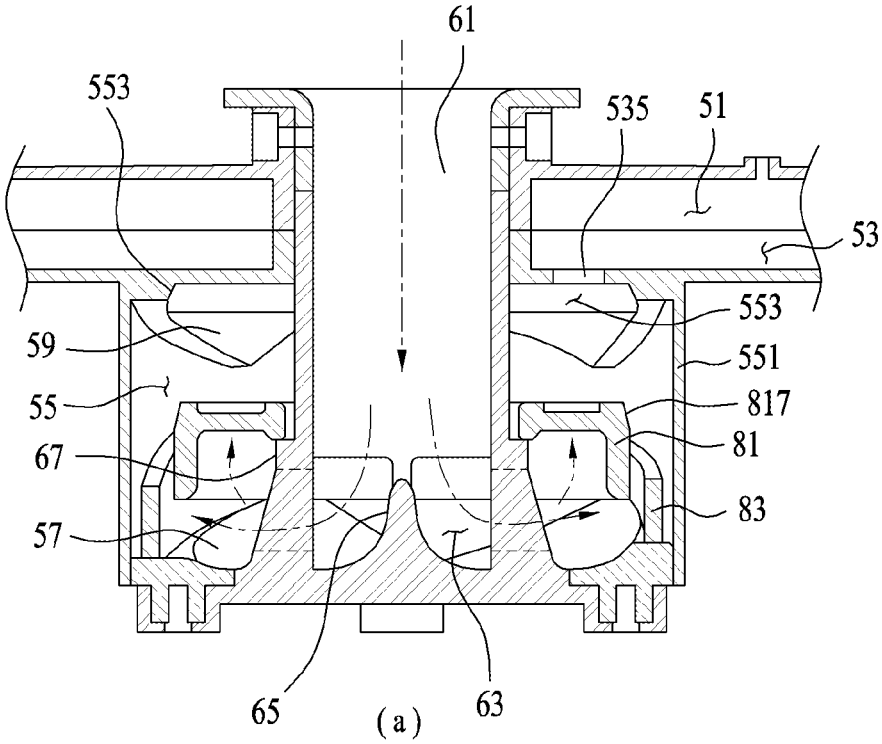
FIGS. 6 and 7 are diagrams illustrating an operational process of the flow path converting unit.
Figure 6:
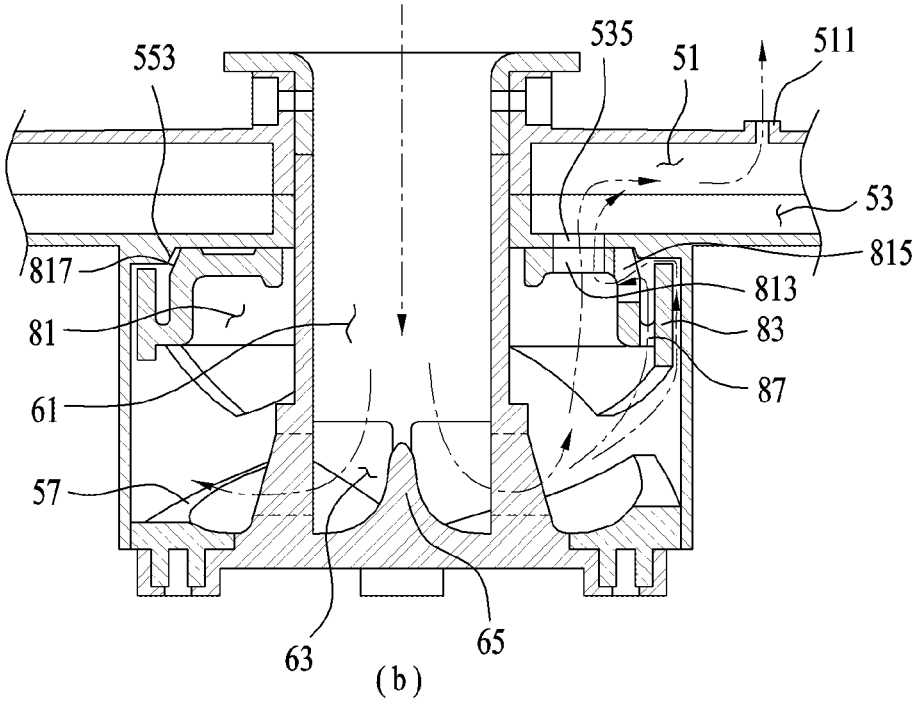

Meanwhile, the rotational motion of the conversion unit body 81 may be realized by diverse structures. FIGS. 5 and 6 show as one example a structure that the conversion body unit 81 is rotated by the engaging projection 83 provided in an outer circumferential surface of the conversion unit body 81, the upper engaging portion 59 provided in the top of the chamber and the lower engaging portion 57 provided in the bottom of the chamber.

The upper engaging portion 59 and the lower engaging portion 57 are provided in a rugged shape (or a tooth wheel shape). The engaging projection 83 includes an upper projection 831 for rotating the conversion unit body 81 a preset angle by engaging with the upper engaging portion 59; and a lower projection 833 for rotating the conversion unit body 81 a preset angle by engaging with the lower engaging portion 57.

Figure 7:
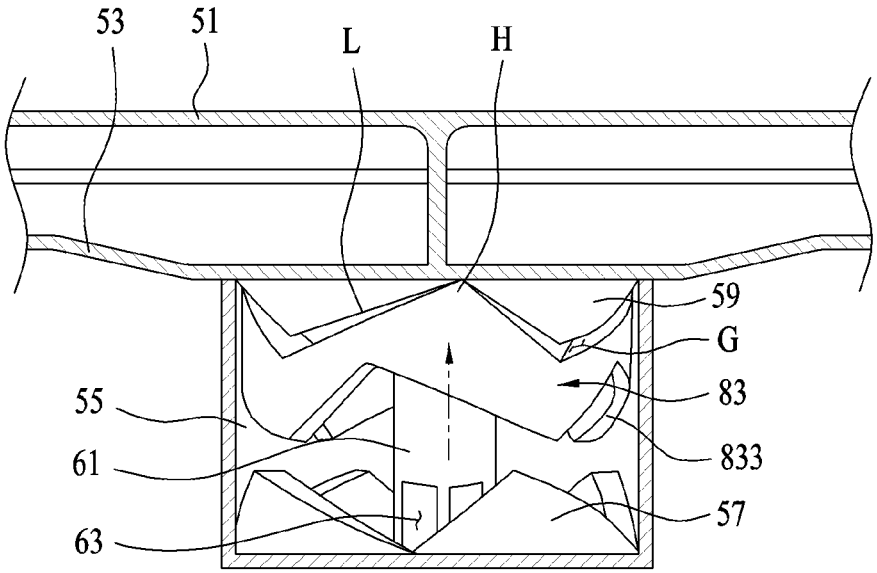

As shown in FIG. 7, the rugged shape of the upper projection 831 and the rugged shape of the upper engaging portion 59 may be formed for a vertex (H) of the upper projection 831 to contact with and then move along a hypotenuse (L) of the upper engaging portion 59, when the conversion unit body 81 is moved to the upper engaging portion 59.

The rugged shape of the lower engaging portion 57 and the rugged shape of the lower projection 832 may be provided to rotate the conversion unit body 81 while a vertex of the lower projection 833 is moving along a hypotenuse of the lower engaging portion 57.

In case of the dishwasher having two channel opening holes 813 spaced 180 degrees apart from each other and four chamber communication holes 535 spaced 90 degrees apart from each other, the conversion unit body 81 is rotated 45 degrees in one direction. When the upper engaging portion 59 is engaging with the upper projection 831, and 45 degrees in the same direction with the rotational direction in which the upper engaging portion 59 engages with the upper projection 831, when the lower engaging portion 57 is engaging with the lower projection 833.

Meanwhile, FIG. 5 shows that the engaging projection 83 is spaced a preset distance apart from the outer circumferential surface of the conversion unit body 81 by a fixing rib 85. Alternatively, it is possible for the engaging projection 83 to be in contact with the outer circumferential surface of the conversion unit body 81. The effect of the engaging projection 83 spaced apart from the conversion unit body 81 by the fixing rib 85 will be described later.

A gap such as a tolerance required in consideration of a design may be provided between an inner wall of the chamber 55 and the outer circumferential surface of the flow path conversion unit 8. Accordingly, the dishwasher including only the configuration mentioned above is likely to have the foreign substances stuck in the space formed between the chamber 55 and the flow path conversion unit 8 so that such the foreign substances might interfere with the linearly reciprocating motion and rotational motion of the flow path conversion unit 81.

The wash water supplied to the chamber 55 by the wash water supply unit 7 may be the water stored in the sump 4 and the wash water sprayed toward the dishwashing objects from the upper spraying arm 5 in the dishwasher.

Accordingly, the wash water collected in the sump 4 has an increasing amount of the food scraps or contaminants removed from the dishwashing objects. The food scraps or contaminants might remain in the chamber 55 or the flow path conversion unit 8 while the wash water is circulating the space formed between the outer circumferential surface of the flow path conversion unit 8 and the inner wall of the chamber 55.

Most of the wash water flowing to the upper surface of the conversion unit body 81 via the space formed between the outer circumferential surface of the conversion unit body 81 and the inner wall of the chamber 55 will be drawn into the lower body 53 via the chamber communication holes 535 of the spraying arm 5. However, as the conversion unit body 81 is moving toward the spraying arm 5, the space between the upper surface of the conversion unit body 81 and the lower body 53 of the spraying arm becomes narrower so that the foreign substances contained in the wash water may be more likely to remain in the chamber 55.

Accordingly, to prevent the foreign substances remaining in the chamber 55 or the flow path conversion unit 8 from interfering with the motion of the flow path conversion unit 8, the dishwasher in accordance with the present disclosure may further include a first slot 815 provided in the conversion unit body 81. The first slit 815 may be configured to guide the wash water circulating between the inner wall of the chamber 55 and the outer circumferential surface of the flow path conversion unit 8 toward the inside of the conversion unit body 81.

The first slit 815 is formed by cutting away an upper outer circumferential surface of the conversion unit body 81 and provided along a longitudinal or circumferential direction of the conversion unit body 81 to be connected with an outer circumferential surface of the channel opening hole 813.

As shown in FIG. 7, it is preferred that the wash water drawn into the space between the outer circumferential surface of the flow path conversion unit 8 and the inner wall of the chamber 55 flow toward the first slit 815 via the space (F) between the upper projection 831 and the upper engaging portion 59 by the engaging of the upper engaging portion 59 and the upper projection 831 with each other in a state of being spaced a present distance apart from each other.

Accordingly, the foreign substances contained in the wash water may be prevented from remaining in the chamber 55 and the flow path conversion unit 8.

Moreover, the flow path conversion unit 8 may further include a second slit (87, see FIG. 5) provided between the conversion unit body 81 and the engaging projection 83 and configured to facilitate the flow of the wash water.

The second slit 87 may be formed by fixing the engaging projection 83 to the conversion unit body 81 by using the fixing rib 85.

As shown in FIG. 5 (*b*), a symmetrical line (A, a symmetrical base line) of the first slit 815 may be spaced a preset distance apart from a symmetrical line (b) of the second slit 87.

That is to wash out the foreign substances remaining on the outer circumferential surface of the conversion unit body 81 by circulating the wash water flowing in the second slit 87 into the conversion unit body 81 via the first slit 815 after circulating along the circumferential direction of the conversion unit body 81.

Meanwhile, when the second slit 87 is provided in the flow path conversion unit 8, no space (G) may be provided between the upper engaging portion 59 and the upper projection 831. In case the space (G) is provided between the upper engaging portion 59 and the upper projection 831, together with the second slit 87, the foreign substances remaining between the outer circumferential surface of the engaging projection 83 and the inner wall of the chamber 55 may be also prevented.

Moreover, the flow path conversion unit 8 may further include an inclined surface 817 and the chamber 55 may further include a chamber inclined surface 553 inclined corresponding to a slope angle of the inclined surface 817.

The inclined surface 817 may be provided along an upper circumferential surface of the conversion unit body 81 and the chamber inclined surface 553 may be provided in the top of the chamber 55 or the upper engaging portion 59.

The inclined surface 817 may be provided in an outer circumferential surface of the engaging projection 83. In this instance, it is preferred that the chamber inclined surface 553 is provided in an upper end of the inner wall of the chamber 55.

The inclined surface 817 and the chamber inclined surface 553 has an effect of facilitating the communication between the channel opening hole 813 and the chamber communication hole 535 when wash water is supplied to the inside of the chamber 55.

Hereinafter, referring to further drawings, the structure of the lower spraying arm 9 will be described.

Figure 8:
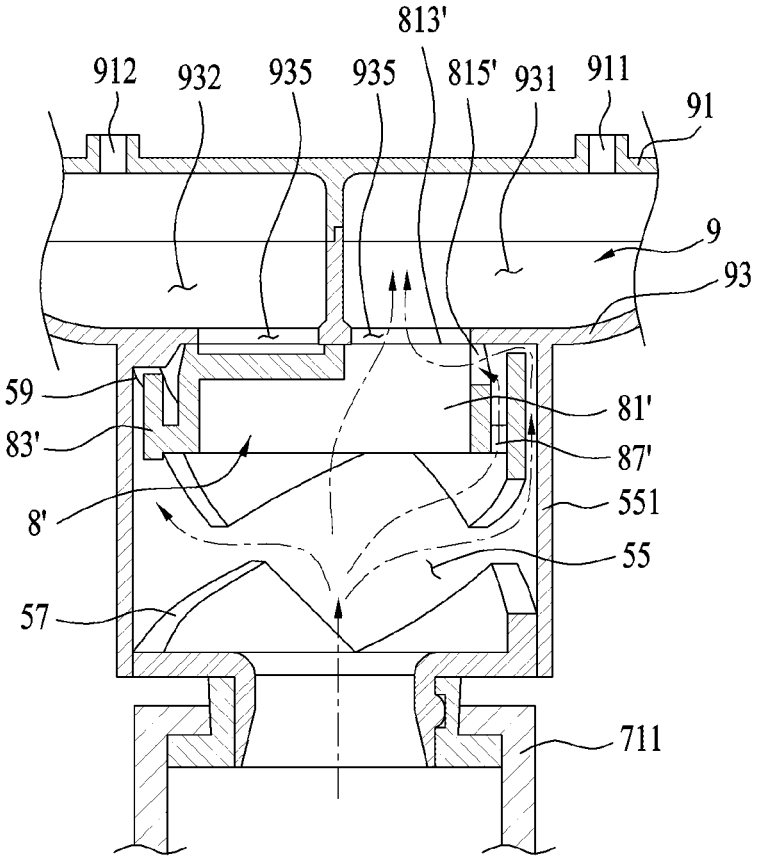
FIG. 8 is a diagram illustrating a coupling structure among a lower spraying arm, a chamber and a flow path converting unit.

FIG. 8 is a diagram illustrating the coupling structure among the lower spraying arm (9, see FIG. 1), the chamber 55 and the flow path conversion unit 8', in case the lower spraying arm 9 for spraying wash water is provided in the lower dish rack 3'.

The entire structure of the lower spraying arm 9 is similar to that of the upper spraying arm 5 mentioned above. Hereinafter, different technical features with the upper spraying arm 5 will be described.

In other words, the lower spraying arm 9 may also include a first channel 931 and a second channel 932 so as to supply wash water. A plurality of spraying holes 911 corresponding to the first channel and a plurality of spraying holes 912 corresponding to the second channel may be provided.

In the embodiment shown in FIG. 8, the first flow path 711 branched from the supply path 71 is configured to supply wash water to the bottom of the chamber 55 and it is not necessary to provide the flow path guider 6, different from the upper spraying arm 5 shown in FIG. 4.

The lower spraying arm 9 may include an upper body 91 having a plurality of spraying holes 911 and 912; a lower body 93 having the first channel 931 and the second channel 932; and a chamber communication hole 935 for allowing the channels to communicate with the chamber 55.

A flow path conversion unit 8' may be further provided in the chamber 55 and configured to perform linearly reciprocating motion and rotational motion to selectively open the chamber communication hole 935.

The flow path conversion unit 8' may include a conversion unit body 81' having an open side; a channel opening hole 813' provided in an upper surface of the conversion unit body and configured to selectively open the chamber communication hole 935; and an engaging projection 83' provided in an outer circumferential surface of the conversion unit body.

The engaging projection 83' includes an upper projection and a lower projection. The chamber 55 includes an upper engaging portion 59 configured to engage with the upper projection to rotate the conversion unit body a preset angle; and a lower engaging portion 57 configured to engage with the lower projection to rotate the conversion unit body a preset angle.

Accordingly, when wash water is supplied to the inside of the chamber 55 via the first flow path 711, the conversion unit body 81' is moved toward the top of the chamber 55. Then, the upper projection of the engaging projection 83' may engage with the upper engaging portion 59 and the conversion unit body 81' may be rotated a preset angle.

When the conversion unit body 81' is rotated, the channel opening hole 813' may some of the chamber communication holes 935 and the wash water may be supplied to some of the channels 931 and 932 provided in the lower spraying arm 9.

After that, the supply pump 73 finishes the wash water supply to the chamber 55, the conversion unit body 81' is moved toward the bottom of the chamber 55. While the lower projection of the engaging projection 83' engages with the lower engaging portion 59, the conversion unit body 81' is rotated a preset angle.

Four channels may be provided in the lower spraying arm 9, spaced 90 degrees apart from each other, and the channel opening holes 813' may be spaced 180 degrees apart from each other. In this instance, the upper engaging portion, the lower engaging portion and the engaging projection 83' are rotated 46 degrees in one direction and the channel opening hole 813' opens the chamber communication hole 935 when the upper engaging portion 59 engages with the upper projection and rotated 45 degrees in the same direction with the rotational direction mentioned above when the lower engaging portion 57 engages with the lower projection.

Moreover, an inclined surface may be provided in an outer circumferential surface of an upper end of the conversion unit body 81' so as to facilitate the coupling between the channel opening hole 813' and the chamber communication hole 935. A chamber inclined surface may be further provided in the chamber 55 to accommodate the inclined surface.

In addition, a first slit 815' and a second slit 87' may be provided in the conversion unit body 81' to prevent foreign substances from remaining in the chamber 55 and the flow path conversion unit 8'. The specific structure for realizing the functions of the first and second slits 815' and 87' are described above and omitted accordingly.

Hereinafter, referring to the accompanying drawing, the components electrically connected with a controller of the dishwasher will be described.

Figure 9:
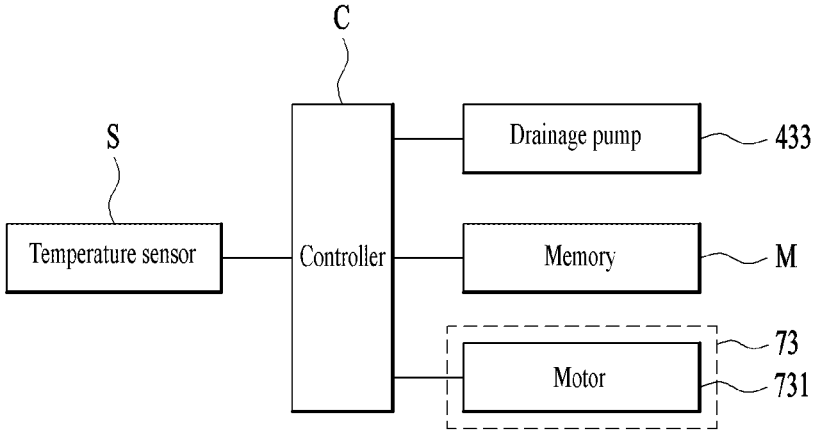
FIG. 9 is a block diagram illustrating a connection relation among a controller, a temperature sensor and a supply pump.

FIG. 9 is a block diagram illustrating a connection relation among a controller, a temperature sensor and a supply pump.

Following description will be made on the base of the upper spraying arm 5 and the same characteristic is applied even to the lower spraying arm 9.

Referring to FIGS. 1 through 3 together with FIG. 9, the dishwasher in accordance with one embodiment may further include a controller (C) implemented to control the drive of the supply pump 73 and the drainage pump 433.

More specifically, the controller (C) may control the motor 731 provided in the supply pump 73 and the motor (not shown) provided in the drainage pump 433.

Meanwhile, the dishwasher 100 in accordance with the embodiment of the present disclosure may further include a current sensor (S) configured to measure values of currents flowing to the motor 731 provided in the supply pump 73; and a memory (M) in which the current values sensed by the temperature sensor (S) are stored.

The current sensor (S) may be electrically connected with the controller (C). Accordingly, the controller (C) may be provided with the current values sensed by the current sensor (S).

The controller (C) may be implemented to control the drive of the motor 731 based on the current value transmitted by the current sensor (S).

More specifically, the controller (C) may control the motor 731 to selectively supply the wash water to the first channel 531 and the second channel 532 provided in the upper spraying arm 5 mentioned above, based on the current value flowing to the motor 731.

For example, when the drive and stop of the supply pump operation is repeated during the wash water supply toward the upper spraying arm 5 by the drive of the supply pump 73, the wash water may be alternatively supplied toward the first channel 531 and the second channel 532 by the operation of the flow path conversion unit 8.

In this instance, the controller (C) may determine which one of the channels the wash water is supplied based on the current value flowing to the motor 731. For example, the state where the wash water is supplied to the first channel is defined as the first state and the state where the wash water is supplied to the second channel is defined as the second state. In this instance, the controller (C) may determine whether the current state is corresponding to the first state or the second state based on variation of the measured current values.

Moreover, the controller (C) may control the drive of the motor 731 to selectively supply the wash water to the first channel 531 and the second channel 532 based on the result of the determination.

Meanwhile, when the wash water is alternatively supplied to the first channel 531 and the second channel 532, the current values flowing to the motor 731 and the result of the determination made by the controller based on the current values may be stored in the memory (M).

Referring to FIG. 2, the sum of the cross section areas of the spraying holes 511 corresponding to the first channel may be larger than the sum of the cross section areas of the spraying holes 512 corresponding to the second channel 532.

For example, the number of the spraying holes 511 corresponding to the first channel 531 may be larger than that of the spraying holes 512 corresponding to the second channel 532. In this instance, if the cross section areas of the spraying holes 511 corresponding to the first channel 531 is equal to the cross section areas of the spraying holes corresponding to the second channel 532, the sum of the cross section areas of the spraying holes 511 corresponding to the first channel 531 may be larger than that of the cross section areas of the spraying holes 512 corresponding to the second channel 532.

Alternatively, the number of the spraying holes 511 corresponding to the first channel 531 may be equal to of the spraying holes 512 corresponding to the second channel 532. In this instance, the diameter of each spraying hole 511 corresponding to the first channel 531 may be larger than the diameter of each spraying hole 512 corresponding to the second channel 532.

In case the sum of the cross section areas of the spraying holes 511 corresponding to the first channel 531 is larger than the sum of the cross section areas of the spraying holes 512 corresponding to the second channel 532, the current value flowing to the motor 731 when wash water is supplied to the first channel 531 may be smaller than the current values flowing to the motor 731 when wash water is supplied to the second channel 532.

Accordingly, when a relatively large current value is sensed by the current sensor (S) during the wash water supply to the first channel 531 and the second channel 532 alternatively, the controller (C) may determine that wash water is supplied to the second channel 532.

For example, the current value flowing to the motor 731 in the first state is defined as the first current value. The current value flowing to the motor 731 in the second state is defined as the second current value. In this instance, the first current value may be smaller than the second current value. That is because the load or torque applied to the motor 731 in the first state is smaller than the load or torque applied to the motor 731 in the second state.

In case the current value flowing to the motor 731 is the first current value which is the relatively smaller one while wash water is supplied to the first or second channel 531 or 532, the controller (C) may determine that the wash water is supplied to the first channel 531. In contrast, when the current value flowing to the motor 531 is the second current value which is the relatively large one, the controller (C) may determine that the wash water is supplied to the second channel 532.

In other words, while the wash water is alternatively supplied to the first channel 531 and the second channel 532, the controller (C) is capable of figuring out the direction of the supplied wash water by sensing the current values flowing to the motor 731.

Meanwhile, the direction of the spraying holes 511 corresponding to the first channel 531 may be different from the direction of the spraying holes 512 corresponding to the second channel 532. For example, the spraying holes 511 corresponding to the first channel 511 and the spraying holes 512 corresponding to the second channel 512 may be directed in the reverse.

More specifically, once the wash water is supplied to the first channel 531, the spraying holes 511 corresponding to the first channel 531 may be formed in one consistent direction to rotate the spraying arm 5 in a clockwise direction. Once wash water is supplied to the second channel 532, the spraying holes 512 may be formed in one consistent direction to rotate the spraying arm 5 in the counter-clockwise direction.

Accordingly, the controller (C) may spray the wash water into the tub 1 while selectively rotating the spraying arm 5 in the clockwise or counter-clockwise direction based on the supply path of the wash water determined from the current values flowing to the motor 731.

In other words, the controller (C) is capable of figuring out the supply direction of the wash water based on the first current value in the first state and the second current value in the second state and then supplying the wash water to the first channel 531 or the second channel 532 selectively by using the supply direction. Accordingly, the controller (C) is capable of controlling the rotational direction of the spraying arm 5 actively.

Meanwhile, the spraying holes 511 corresponding to the first channel 531 may be configured to spray the wash water toward the dishwashing objects held in the tub 1.

The spraying holes 512 corresponding to the second channel 532 may include a first spraying hole configured to spray wash water toward the dispenser (D) accommodating the dishwasher detergent; and a second spraying hole configured to spray wash water toward a filter (F) provided in a top surface of the sump 4.

Referring to FIG. 1, the dispenser (D) may be provided toward the inside of the tub 1 from the rear surface of the door 2.

In this instance, the other ones of the spraying holes 512 corresponding to the second channel 532, except the first spraying hole and the second spraying hole, may be configured to spray the wash water toward the dishwashing objects.

For example, referring to FIG. 1, the first spraying holes 5121 and 9121 are formed in a lower surface of the spraying arm 5 and configured to spray wash water toward the dispenser (D). The first spraying holes 5121 and 9121 may be the ones located in both ends in a longitudinal direction of the lower spraying arm 9 out of the spraying holes 912 formed in an upper surface of the spraying arm 9.

The second spraying holes 5122 and 9122 may be provided in a lower surface of at least one of the upper and lower spraying arms 5 and 9 and configured to spray wash water toward the filter (F).

Accordingly, when the wash water needs to be intensively sprayed toward the dispenser (D), the controller (C) may control the supply pump 73 to supply the wash water toward the second channel 532 for a preset time period.

In addition, even when the wash water needs to be intensively sprayed toward the filter (F) to wash off the filter (F), the controller (C) may control the supply pump 73 to supply the wash water toward the second channel 532 for a preset time period.

Meanwhile, when the dishwasher 100 is driven according to a preset dishwashing course, the controller (C) may figure out the current value flowing to the motor 731 during the wash water supply to the first channel 531 and the current value flowing to the motor 731 during the water supply to the second channel 532. The controller (C) may control the motor 731 to supply the wash water to the second channel 532 for a preset time period based on the current value information.

In this instance, the preset dishwashing course may include all of the dishwashing courses input by the user.

More specifically, before a dishwashing cycle of the dishwashing course input by the user starts, the controller may figure out the current values flowing to the motor when the wash water is supplied to the first channel 531 and the second channel 532.

After that, in an initial stage of the dishwashing cycle, the controller (C) may supply the wash water via the second channel 532 for a preset time period by controlling the motor 731.

In the initial stage of the dishwashing course, the wash water is intensively sprayed toward the dispenser (D) so as to wash off the dishwashing detergents stored in the dispenser (D) sufficiently.

For example, the preset dishwashing course may include a channel determining cycle for implementing the controller (C) to determine information about the states of the first channel 531 and the second channel 532; and a dishwashing cycle for spraying wash water toward the dishwashing objects held in the tub 11.

At this time, the channel determining cycle and the dishwashing cycle may be performed in order. The supply pump 73 (or the motor 731) may be controlled by the controller (C) to supply the wash water via the second channel 532 for a preset time period in the initial stage of the dishwashing cycle.

Accordingly, the wash water may be intensively sprayed toward the dispenser (D) in the initial stage of the dishwashing cycle. The dishwasher detergent stored in the dispenser (D) can be washed off.

Hereinafter, a control method of the dishwasher in accordance with one embodiment will be described.

Figure 10:
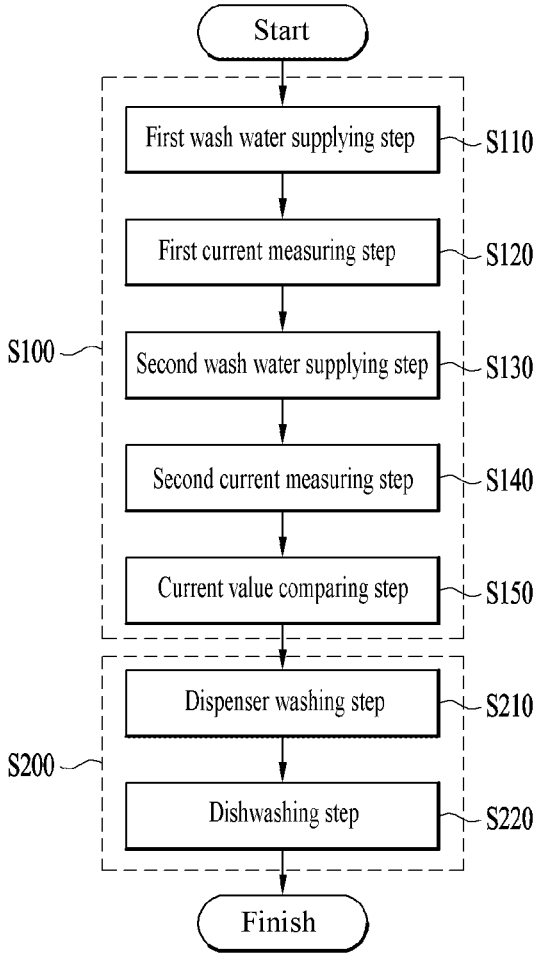
FIG. 10 is a flow chart illustrating a control method of a dishwasher in accordance with one embodiment of the present disclosure.

FIG. 10 is a flow chart illustrating a control method of a dishwasher in accordance with one embodiment of the present disclosure.

In describing the control method of the dishwasher referring to FIG. 10, it is obvious that the structure of the dishwasher mentioned above referring to FIGS. 1 through 9 should be applied to the control method.

For easy explanation, the spraying arm will be mentioned, without dividing the spraying arm into the upper spraying arm 5 and the lower spraying arm 9.

Referring to FIG. 10, the control method of the dishwasher in accordance with one embodiment may include a channel determining step (S100) for implementing the controller (C) to determine the supply direction of the wash water; a washing step (S200) for spraying wash water toward the dishwashing objects held in the tub 1. In this instance, the supply direction of the wash water may include the first state in which the wash water is supplied to the first channel 531; and the second state in which the wash water is supplied to the second channel 532.

The channel determining step (S100) may include a first wash water supplying step (S110) for supplying the wash water to one of the first and second channels 531 and 532; a first current measuring step (S120) for measuring the current value flowing to the motor 731 provided in the supply pump 73; a second wash water supplying step (S130) for supplying the wash water to the other one channel; a second current measuring step (S140) for measuring the current value flowing to the motor 731; and a current value comparing step (S150) for implementing the controller (C) to compare the current value measured in the first current measuring step (S120) with the current value measured in the second current measuring step.

In the first wash water supplying step (S110), the supply pump 73 is driven to supply wash water to one of the first and second channels 531 and 532.

In the first current measuring step (S120), the current sensor (S) measures the current value flowing to the motor 731 provided in the supply pump 73 during the first wash water supply step (S110) and transmits the measured current value to the controller (C).

More specifically, the first current value may be the current value flowing to the motor 731 driven in the first wash water supply step (S110).

In the second wash water supplying step (S130), the wash water may be supplied to the other one of the first and second channels 531 and 532 by the drive of the supply pump 73.

After that, in the second current measuring step (S140), the current sensor (S) may measure the current value flowing to the motor 731 provided in the supply pump 73 during the second wash water supplying step (S130) and transmit the measured current value to the controller (C).

In other words, the second current value may be the value of the current flowing to the motor 731 driven in the second wash water supplying step (S130).

In the current value comparing step (S150), the controller (C) may compare the current value measured in the first current measuring step (S120) with the current value measured in the second current measuring step (S140). Based on the result of the comparison, the controller (C) may determine the first current value flowing to the motor 731 when the wash water is supplied to the first channel 531 and the second current value flowing to the motor 731 when the wash water is supplied to the second channel 532.

In other words, in the current value comparing step (S150), the controller (C) may determine the first state in which wash water is supplied to the first channel 531 and the second state in which wash water is supplied to the second channel 532, based on the result of the current value comparison.

Meanwhile, the sum of the cross section areas of the spraying holes 511 corresponding to the first channel 531 may be larger than the sum of the cross section areas of the spraying holes 512 corresponding to the second channel 532.

At this time, when a relatively large one of the first and second current values is sensed, it is determined by the controller (C) that wash water is supplied to the second channel 532. In contrast, when a relatively small one of the first and second current values is sensed, it is determined by the controller (C) that wash water is supplied to the first channel 531.

More specifically, the current value flowing to the motor 731 in the first state may be smaller than the current value flowing to the motor 731 in the second state.

Meanwhile, the drive of the supply pump 73 may be stopped for a preset time period between the first current measuring step (S120) and the second wash water supplying step (S130).

That is to allow the flow path conversion unit 8 mentioned above to convert the flow path of the supplied wash water. As the drive and stop of the supply pump 73 is repeated, the flow path conversion unit 8 is driven and wash water is alternatively supplied to the first channel 531 and the second channel 532.

The spraying holes 512 corresponding to the second channel 532 may include at least one spraying hole 5121 formed to spray wash water toward the dispenser (D) accommodating the dishwasher detergents.

The washing step (S200) includes a first dispenser washing step S210 for supplying wash water to the second channel 532; and a dishwashing step (S220) for supplying wash water to the first channel 531.

In the washing step (S200), dishwashing may be performed after washing the dispenser (D) so as to intensively and sufficiently wash off the dishwasher detergents stored in the dispenser (D) in an initial stage of the washing step.

More specifically, the dispenser washing step (S220) may be performed in the initial stage of the washing step (S200) for a preset time period.

As mentioned above, the controller (C) may determine which one of the channels wash water is supplied through so that it can be possible to supply wash water to one specific channel at a specific point of time selectively and intensively.

According to the dishwasher and the control method mentioned above, the controller is capable of determining or recognizing which one of the channels provided in the spraying arm the wash water is supplied through.

Furthermore, the wash water can be intensively supplied toward the dispenser in the initial stage of the washing cycle by the determination of the channel to which the wash water is supplied.

Still further, the rotational direction of the spraying arm may be actively controlled by the determination of the channel to which the wash water is supplied.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

The invention claimed is:

1. A method for controlling a dishwasher comprising a tub, a spraying arm, a supply pump comprising an impeller and a motor and configured to supply wash water to the spraying arm, and a controller configured to control an operation of the supply pump, wherein the spraying arm comprises first and second channels configured to independently guide the wash water and a plurality of spraying holes configured to spray the wash water supplied to each of the channels in preset directions, wherein a first spraying direction of the spraying holes in fluid communication with the first channel is different from a second spraying direction of the spraying holes in fluid communication with the second channel, wherein the spraying arm rotates in a clockwise direction in response to the wash water being supplied to the first channel, and the spraying arm rotates in a counter-clockwise direction in response to the wash water being supplied to the second channel, wherein a first total area of the spraying holes in fluid communication with the first channel is different from a second total area of the spraying holes in fluid communication with the second channel, and wherein the method comprises:

performing a channel determining step that determines whether the spraying arm is in a first state in which the wash water is being supplied to the first channel or a second state in which the wash water is being supplied to the second channel; and performing a washing step that sprays wash water toward dishwashing objects held in the tub based on the channel determining step, the washing step comprising:

controlling the rotation direction of the spraying arm by controlling, based on a current flowing to the motor, the operation of the supply pump to selectively supply the wash water to the first channel or the second channel.

2. The method of claim 1, wherein performing the channel determining step comprises:

performing a first wash water supplying step that supplies the wash water to one of the first and second channels by controlling the operation of the supply pump;

performing a first current measuring step that measures a first current value of an electrical current flowing through the motor during the first wash water supplying step;

performing a second wash water supplying step that supplies the wash water to the other one of the first and second channels by controlling the operation of the supply pump;

performing a second current measuring step that measures a second current value of the electrical current flowing through the motor during the second wash water supplying step; and performing a current value comparing step that compares the first and second current values.

3. The method of claim 2, wherein performing the channel determining step further comprises:

determining, based on a result of the current value comparing step, whether the spraying arm is in the first state in which the wash water is being supplied to the first channel and the second state in which the wash water is being supplied to the second channel, the determining comprising:

determining whether the value of the electrical current flowing through the motor is smaller than the second current;

based on a determination that the value of the electrical current flowing through the motor is smaller than the second current, determining that the spraying arm is in the first state; and based on a determination that the value of the electrical current flowing through the motor is greater than or equal to the second current, determining that the spraying arm is in the second state.

4. The method of claim 3, wherein a first total area of the spraying holes in fluid communication with the first channel is larger than a second total area of the spraying holes in fluid communication with the second channel, and wherein the first current value of the electrical current flowing through the motor in the first state is smaller than the second current value of the electrical current flowing through the motor in the second state.

5. The method of claim 2, further comprising:

stopping the operation of the supply pump between the first current measuring step and the second wash water supplying step.

6. The method of claim 1, wherein the spraying holes in fluid communication with the second channel comprise at least one spraying hole configured to spray the wash water toward a dispenser configured to accommodate dishwasher detergents, and wherein performing the washing step comprises:

performing a dispenser washing step that supplies the wash water to the second channel; and performing a dishwashing step that supplies the wash water to the first channel.

7. The method of claim 6, wherein performing the dispenser washing step comprises performing the dispenser washing step during an initial stage of the washing step for a preset time period.

* * * * *